US010964270B2

(12) United States Patent
Kim et al.

(10) Patent No.: US 10,964,270 B2
(45) Date of Patent: Mar. 30, 2021

(54) DISPLAY DEVICE AND METHOD OF DRIVING THE SAME

(71) Applicant: Samsung Display Co., Ltd., Yongin-si (KR)

(72) Inventors: Ji Woong Kim, Yongin-si (KR); Oh Jo Kwon, Yongin-si (KR); Hyo Jin Lee, Yongin-si (KR); Se Hyuk Park, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/817,527

(22) Filed: Mar. 12, 2020

(65) Prior Publication Data

US 2020/0294451 A1 Sep. 17, 2020

(30) Foreign Application Priority Data

Mar. 15, 2019 (KR) ..... 10-2019-0030158

(51) Int. Cl.
*G09G 3/3266* (2016.01)
*G09G 3/3291* (2016.01)

(52) U.S. Cl.
CPC ..... *G09G 3/3266* (2013.01); *G09G 3/3291* (2013.01); *G09G 2300/0842* (2013.01); *G09G 2310/0264* (2013.01)

(58) Field of Classification Search
CPC ..... G09G 3/3266; G09G 3/3275–3291; G09G 2300/0842; G09G 2310/0264–0275; G09G 2310/0291
See application file for complete search history.

(56) References Cited

U.S. PATENT DOCUMENTS 9,823,729 B2 11/2017 An et al.
9,934,750 B2 4/2018 Park et al.
2015/0123119 A1* 5/2015 Sekine ..... H01L 27/14685 257/43
2016/0063962 A1 3/2016 Park et al.
2016/0180764 A1* 6/2016 Noh ..... G09G 3/3688 345/690

(Continued)

FOREIGN PATENT DOCUMENTS

CN 106782259 A * 5/2017 ..... G09G 3/3275
CN 106875891 A * 6/2017 ..... G09G 3/3233

(Continued)

*Primary Examiner* — Michael Pervan
(74) *Attorney, Agent, or Firm* — H.C. Park & Associates, PLC

(57) ABSTRACT

A method of driving a pixel including: during a first period of a first frame, applying a first scan signal having a turn-on level to the first scan line, applying a data voltage to a data line, and applying a second scan signal having the turn-on level to the second scan line; and during a second period of a second frame, applying the first scan signal having the turn-on level to the first scan line, applying a bias voltage to the data line, and applying the second scan signal having a turn-off level to the second scan line, the second frame is a frame subsequent to the first frame, the second period is longer than the first period, and a light-emitting diode emits light at luminance based on the data voltage during at least a portion of the first frame and at least a portion of the second frame.

20 Claims, 17 Drawing Sheets

(56) References Cited

U.S. PATENT DOCUMENTS

| | | | | |
|---|---|---|---|---|
| 2017/0061875 | A1 | 3/2017 | Cho et al. | |
| 2017/0193890 | A1 | 7/2017 | Kim et al. | |
| 2019/0114970 | A1* | 4/2019 | Moradi | G09G 3/3291 |

FOREIGN PATENT DOCUMENTS

| | | | | | |
|---|---|---|---|---|---|
| CN | 106991944 | A | * | 7/2017 | G09G 3/3275 |
| KR | 10-2015-0100978 | | | 9/2015 | |
| KR | 10-2016-0027558 | | | 3/2016 | |
| KR | 10-2016-0052942 | | | 5/2016 | |
| KR | 10-2017-0026762 | | | 3/2017 | |
| KR | 10-2017-0080793 | | | 7/2017 | |
| KR | 10-2018-0032256 | | | 3/2018 | |

* cited by examiner

DISPLAY DEVICE AND METHOD OF DRIVING THE SAME

CROSS-REFERENCE TO RELATED APPLICATION

This application claims priority from and the benefit of Korean Patent Application No. 10-2019-0030158, filed on Mar. 15, 2019, which is hereby incorporated by reference for all purposes as if fully set forth herein.

BACKGROUND

Field

Exemplary embodiments of the invention relate generally to a display device and a method of driving the same.

Discussion of the Background

With the development of information technologies, the importance of a display device that serves as a connection medium between a user and information increases. Accordingly, display devices such as a liquid crystal display device, an organic light-emitting display device, and a plasma display device are increasingly used.

The display device may be driven at a normal frequency when displaying a general image or video. For example, when the normal frequency is 60 Hz, 60 frames per second may be viewed by a user.

In addition, when the display device displays a static image or is in a standby mode (for example, an always-on mode), the display device may be driven at a low frequency. For example, when the low frequency is 1 Hz, a data voltage may be written only with respect to a first frame for one second, and a corresponding data voltage may be maintained with respect to the remaining 59 frames.

When a driving frequency is converted from the normal frequency to the low frequency, in order to prevent unnecessary power consumption, the display device may not generate a data voltage with respect to the remaining 59 frames. In this case, there is a problem in that a flicker is recognized as a data line turns into a floating state.

The above information disclosed in this Background section is only for understanding of the background of the inventive concepts, and, therefore, it may contain information that does not constitute prior art.

SUMMARY

An exemplary embodiment of the invention provides a display device capable of preventing occurrence of flicker when a driving frequency is converted from a normal frequency to a low frequency, and a method of driving the same.

Additional features of the inventive concepts will be set forth in the description which follows, and in part will be apparent from the description, or may be learned by practice of the inventive concepts.

A method of driving a display device according to an exemplary embodiment of the invention includes driving a pixel which includes a first node connected to a data line when a first scan signal having a turn-on level is applied to a first scan line, a second node connected to an initialization line when a second scan signal having a turn-on level is applied to a second scan line, a first transistor of which a gate electrode is connected to the first node and one electrode is connected to the second node, and a light-emitting diode of which an anode is connected to the second node, the method including during a first period of a first frame, applying the first scan signal having the turn-on level to the first scan line, applying a data voltage to the data line, and applying the second scan signal having the turn-on level to the second scan line; and during a second period of a second frame, applying the first scan signal having the turn-on level to the first scan line, applying a bias voltage to the data line, and applying the second scan signal having a turn-off level to the second scan line, wherein the second frame is a frame subsequent to the first frame, the second period is longer than the first period, and the light-emitting diode emits light at luminance based on the data voltage during at least a portion of the first frame and at least a portion of the second frame.

The light-emitting diode may emit the light at the luminance based on the data voltage when an emission signal having a turn-on level is applied to an emission line and may be in a non-emission state when the emission signal having a turn-off level is applied to the emission line, the emission signal having the turn-off level may be applied to the emission line during a third period of the first frame and a fourth period of the second frame, the third period may be a period including the first period, and the second period may be a period including the fourth period.

The data line may be connected to a bias line through a first switch during the second period.

The data line may be connected to one terminal of an amplifier, and the other terminal of the amplifier may be connected to a bias line through a first switch during the second period.

A method of driving a display device according to an exemplary embodiment of the invention includes driving a pixel which includes a first node connected to a data line when a first scan signal having a turn-on level is applied to a first scan line, a second node connected to an initialization line when a second scan signal having a turn-on level is applied to a second scan line, a first transistor of which a gate electrode is connected to the first node and one electrode is connected to the second node, and a light-emitting diode of which an anode is connected to the second node, the method including during a first period of a first frame, applying the first scan signal having the turn-on level to the first scan line, applying a data voltage to the data line, and applying the second scan signal having the turn-on level to the second scan line; and during a second period of a second frame, applying the first scan signal having a turn-off level to the first scan line, applying a bias voltage to the initialization line, and applying the second scan signal having the turn-on level to the second scan line, wherein the second frame is a frame subsequent to the first frame, the second period is longer than the first period, and the light-emitting diode emits light at luminance based on the data voltage during at least a portion of the first frame and at least a portion of the second frame.

The light-emitting diode may emit the light at the luminance based on the data voltage when an emission signal having a turn-on level is applied to an emission line and may be in a non-emission state when the emission signal having a turn-off level is applied to the emission line, the emission signal having the turn-off level may be applied to the emission line during a third period of the first frame and a fourth period of the second frame, the third period may be a period including the first period, and the second period may be a period including the fourth period.

The initialization line may be connected to a bias line through a first switch during the second period.

The initialization line may be connected to one terminal of an amplifier, and the other terminal of the amplifier may be connected to a bias line through a first switch during the second period.

A display device according to an exemplary embodiment of the invention includes a pixel; and a bias voltage applier connected to the pixel, wherein the pixel includes a first transistor including a gate electrode connected to a first node and one electrode connected to a second node, a second transistor including a gate electrode connected to a first scan line, one electrode connected to a data line, and the other electrode connected to the first node, a third transistor including a gate electrode connected to a second scan line, one electrode connected to the second node, and the other electrode connected to an initialization line, a storage capacitor including one electrode connected to the first node and the other electrode connected to the second node, and a light-emitting diode including an anode connected to the second node, and the bias voltage applier includes a first switch including one terminal connected to the bias line, and an amplifier including one terminal connected to the pixel and the other terminal connected to the other terminal of the first switch.

The bias voltage applier may further include a second switch including one terminal connected to the one terminal of the amplifier and the other terminal connected to an output terminal of the amplifier, and a sampling capacitor including one electrode connected to the one terminal of the amplifier and the other terminal connected to the output terminal of the amplifier.

The one terminal of the amplifier may be connected to the data line.

During a first period of a first frame, the second transistor and the third transistor may be in a turn-on state, and the first switch may be in a turn-off state.

During a second period of a second frame, the second transistor may be in a turn-on state, the third transistor may be in a turn-off state, and the first switch may be in a turn-on state.

The second frame may be a frame subsequent to the first frame, and the second period may be longer than the first period.

The pixel may further include a fourth transistor including a gate electrode connected to the emission line and one electrode connected to the other electrode of the first transistor, the fourth transistor may be in a turn-off state during a third period of the first frame and a fourth period of the second frame, the third period may be a period including the first period, and the second period may be a period including the fourth period.

The one terminal of the amplifier may be connected to the initialization line.

During a first period of a first frame, the second transistor and the third transistor may be in a turn-on state, and the first switch may be in a turn-off state.

During a second period of a second frame, the second transistor may be in a turn-off state, the third transistor may be in a turn-on state, and the first switch may be in a turn-on state.

The second frame may be a frame subsequent to the first frame, and the second period may be longer than the first period.

The pixel may further include a fourth transistor including a gate electrode connected to the emission line and one electrode connected to the other electrode of the first transistor, the fourth transistor may be in a turn-off state during a third period of the first frame and a fourth period of the second frame, the third period may be a period including the first period, and the second period may be a period including the fourth period.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION

Figure 1:
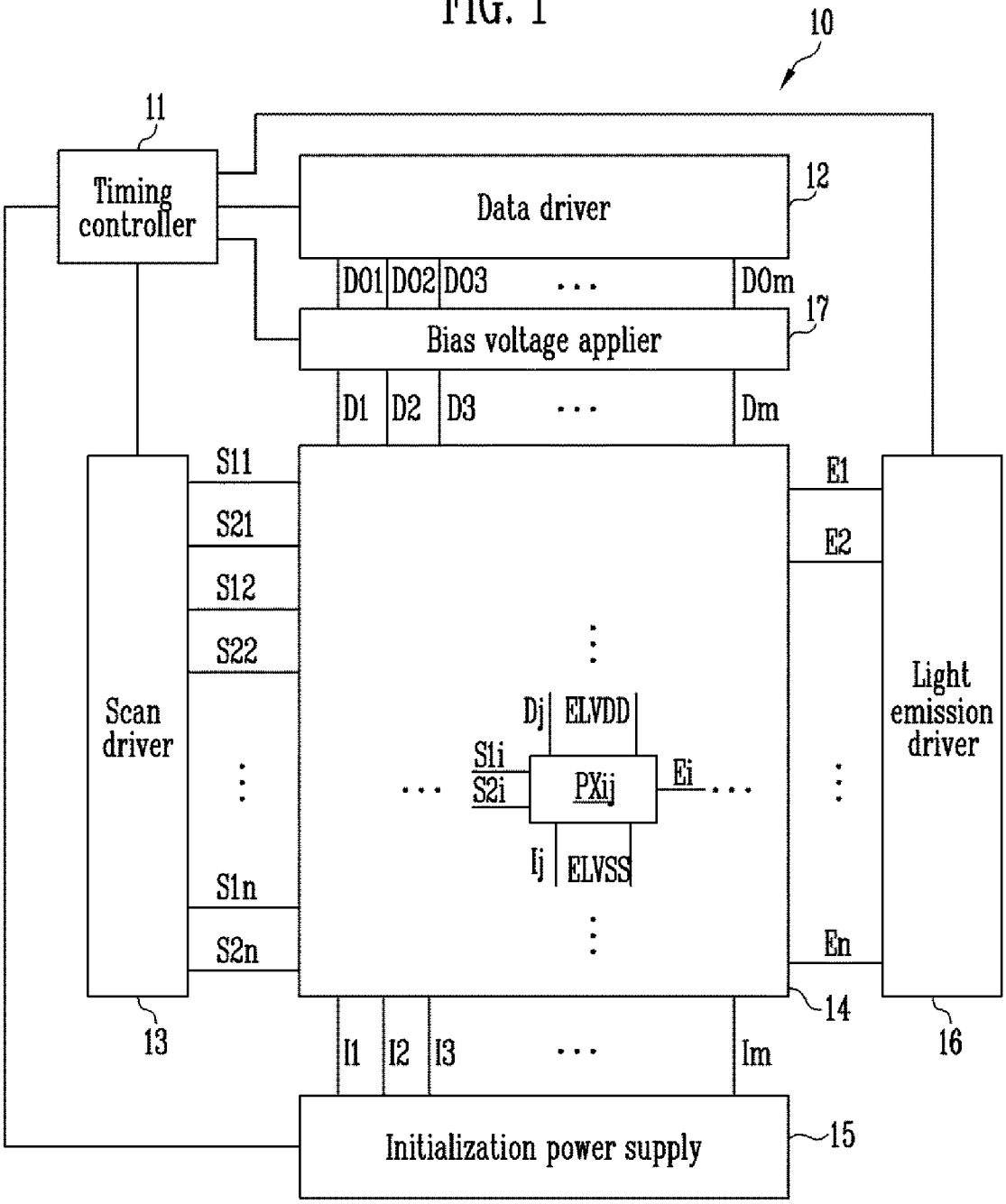
FIG. 1 is a view illustrating a display device according to an exemplary embodiment of the invention.

In the following description, for the purposes of explanation, numerous specific details are set forth in order to provide a thorough understanding of various exemplary embodiments or implementations of the invention. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As is customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some exemplary embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

FIG. 1 is a view illustrating a display device according to an exemplary embodiment of the invention.

Referring to FIG. 1, a display device 10 according to an exemplary embodiment of the invention includes a timing controller 11, a data driver 12, a scan driver 13, a pixel unit 14, an initialization power supply 15, a light emission driver 16, and a bias voltage applier 17.

The timing controller 11 may receive frame information and control signals from an external processor. The timing controller 11 may convert the received frame information and control signals so as to be suitable for a specification of the display device 10 and may provide the converted frame information and control signals to the data driver 12, the scan driver 13, and the light emission driver 16. For example, the timing controller 11 may supply gray scale values and control signals with respect to pixels of the pixel unit 14 to the data driver 12. In addition, the timing controller 11 may supply control signals such as a clock signal and a scan start signal to the scan driver 13. Furthermore, the timing controller 11 may supply control signals such as a clock signal and a light emission stop signal to the light emission driver 16.

The data driver 12 may generate data voltages to be provided to data output lines DO1, DO2, DO3, and DOm using the gray scale values and the control signals received from the timing controller 11. Here, m may be an integer greater than zero.

The bias voltage applier 17 may transmits the data voltages supplied from the data output lines DO1, DO2, DO3, and DOm to the data lines D1, D2, D3, Dj, and Dm or may supply bias voltages to the data lines D1, D2, D3, Dj, and Dm by connecting the data lines D1, D2, D3, and Dj, and Dm to bias lines.

The scan driver 13 may receive the control signals such as the clock signal and the scan start signal from the timing controller 11 and may generate first scan signals to be provided to first scan lines S11, S12, S1*i*, and S1*n* and second scan signals to be provided to second scan lines S21, S22, S2*i*, and S2*n*. Here, n may be an integer greater than zero.

The light emission driver 16 may receive the control signals such as the clock signal and the light emission stop signal from the timing controller 11 and may generate emission signals to be provided to emission lines E1, E2, Ei, and En.

The initialization power supply 15 may supply initialization voltages to initialization lines I1, I2, I3, Ij, and Im.

The pixel unit 14 includes pixels. For example, a pixel PXij may be connected to a data line Dj, a first scan line S1*i*, a second scan line S2*i*, an emission line Ei, and an initialization line Ij, which correspond thereto. In addition, the pixel PXij may be connected to a first power supply line ELVDD and a second power supply line ELVSS.

Figure 2:
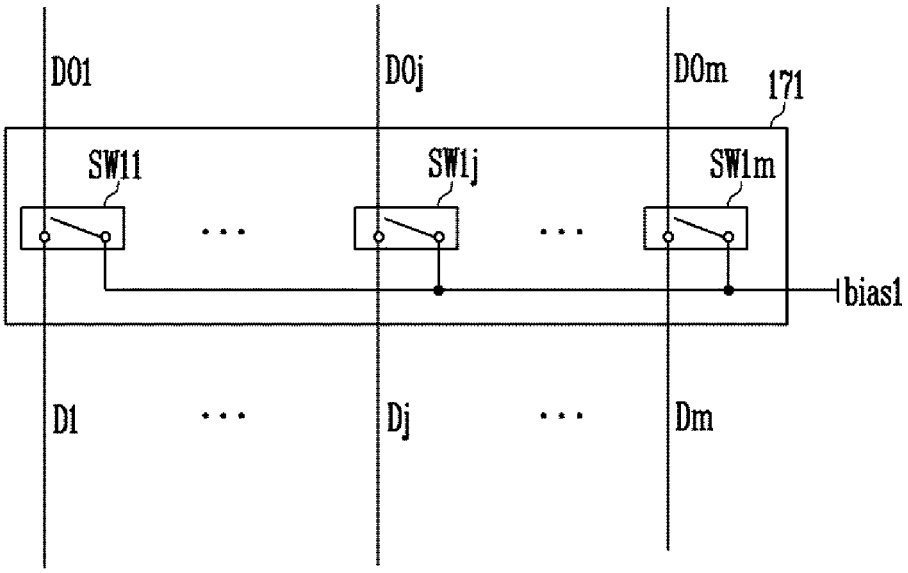
FIG. 2 is a view illustrating a bias voltage applier according to a first exemplary embodiment of the invention.

FIG. 2 is a view illustrating a bias voltage applier according to a first exemplary embodiment of the invention.

Referring to FIG. 2, a bias voltage applier 171 according to the first exemplary embodiment of the invention may include switches SW11, SW1*j*, and SW1*m*.

The number of the switches SW11, SW1*j*, and SW1*m* may correspond to the number of data lines D1, Dj, and Dm. For example, the number of the switches SW11, SW1*j*, and SW1*m* may be equal to the number of the data lines D1, Dj, and Dm.

For example, one terminal of the switch SW1*j* may be connected to the data line Dj, and the other terminal thereof may be connected to a bias line bias1. For example, regardless of a state of the switch SW1*j*, a data output line DOj and the data line Dj may be always connected.

When the switch SW1*j* is in a turn-off state, the data line Dj may receive a data voltage from the data output line DOj.

When the switch SW1*j* is in a turn-on state, the data line Dj may be connected to the bias line bias1. In this case, a bias voltage applied to the bias line bias1 may be applied to the data line Dj. Here, the data output line DOj may be in a floating state. That is, a data voltage may not be supplied from a data driver 12 to the data output line DOj.

Figure 3:
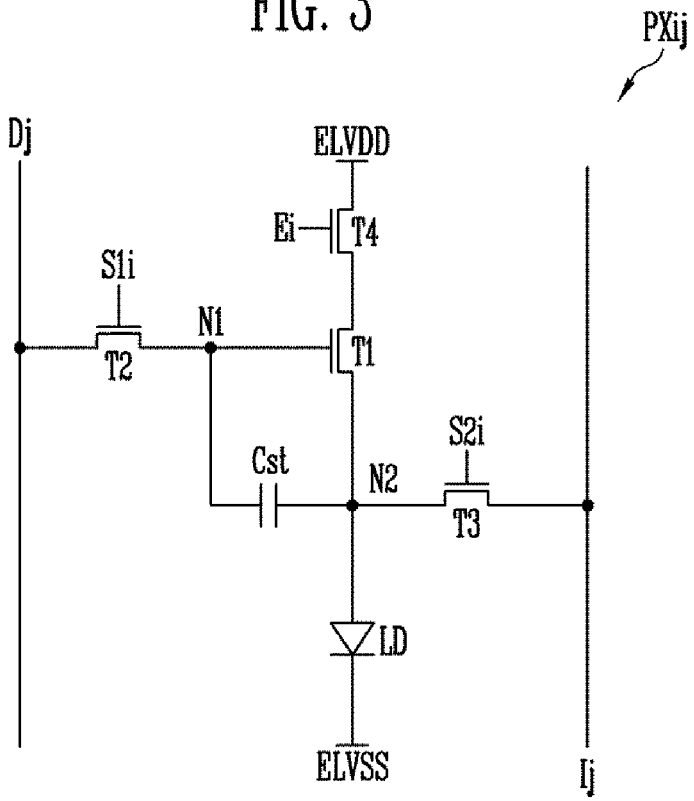
FIG. 3 is a view illustrating a pixel according to an exemplary embodiment of the invention.

FIG. 3 is a view illustrating a pixel according to an exemplary embodiment of the invention.

Referring to FIG. 3, a pixel PXij according to the exemplary embodiment of the invention may include transistors T1, T2, T3, and T4, a storage capacitor Cst, and a light-emitting diode LD.

Hereinafter, it is assumed that the transistors T1 to T4 are N-type transistors (for example, an N-type metal-oxide semiconductor (NMOS) transistor), but those skilled in the art may implement the transistors T1 to T4 as a P-type transistor (for example, a p-type metal-oxide semiconductor (PMOS) transistor) or a combination of the NMOS transistor and the PMOS transistor.

A gate electrode of a first transistor T1 may be connected to a first node N1, one electrode thereof may be connected to a second node N2, and the other electrode thereof may be connected to one electrode of a fourth transistor T4. The first transistor T1 may be referred to as a driving transistor.

A gate electrode of a second transistor T2 may be connected to a first scan line S1*i*, one electrode thereof may be connected to the data line Dj, and the other electrode thereof may be connected to the first node N1. The second transistor T2 may be referred to as a scan transistor, a switching transistor, or the like.

A gate electrode of a third transistor T3 may be connected to a second scan line S2*i*, one electrode thereof may be connected to a second node N2, and the other electrode thereof may be connected to an initialization line Ij. The third transistor T3 may be referred to as an initialization transistor.

A gate electrode of a fourth electrode T4 may be connected to an emission line Ei, one electrode thereof may be connected to the other electrode of the first transistor T1, and the other electrode thereof may be connected to a first power line ELVDD.

One electrode of the storage capacitor Cst may be connected to the first node N1, and the other electrode thereof may be connected to the second node N2.

An anode of the light-emitting diode LD may be connected to the second node N2, and a cathode thereof may be connected to a second power supply line ELVSS. The light-emitting diode LD may be an organic light-emitting diode, an inorganic light-emitting diode, or a quantum dot light-emitting diode.

In addition, only one light-emitting diode LD is shown in FIG. 3, but the light-emitting diode LD may be provided with a plurality of ultra-small light-emitting diodes. For example, the plurality of ultra-small light-emitting diodes may be arranged in parallel so as to have the same polarity or different polarities.

The above-described configuration is only an exemplary embodiment in which the pixel PXij is embodied, and the pixel PXij may be modified into various types. For example, in a case in which the pixel PXij includes the first node N1 connected to the data line Dj when a first scan signal having a turn-on level is applied to the first scan line S1*i* and includes the second node N2 connected to the initialization line Ij, the first transistor T1 including the gate electrode connected to the first node N1 and one electrode connected to the second node N2, and the light-emitting diode LD including the anode connected to the second node N2 when a second scan signal having a turn-on level is applied to the second scan line S2*i*, the exemplary embodiments of the invention may be applied. It is necessary to specifically consider whether the exemplary embodiments of the invention are operated in a corresponding pixel.

Figure 4:
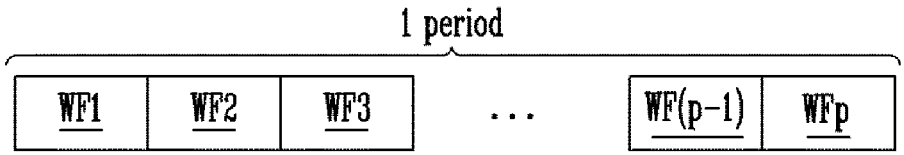
FIG. 4 is a graph illustrating a case in which a display device is driven at a normal frequency.

FIG. 4 is a graph illustrating a case in which a display device is driven at a normal frequency.

When a driving frequency of the display device is a normal frequency, one period may include first frame periods of first frames WF1, WF2, WF3, WF(p−1), and WFp. p may be an integer greater than zero. For example, when the normal frequency is 60 Hz, p may be 60.

Each pixel may receive a data voltage corresponding to the first frame period of each of the first frames WF1 to WFp. For example, when p is 60, each pixel may update the data voltage 60 times during one period.

Figure 5:
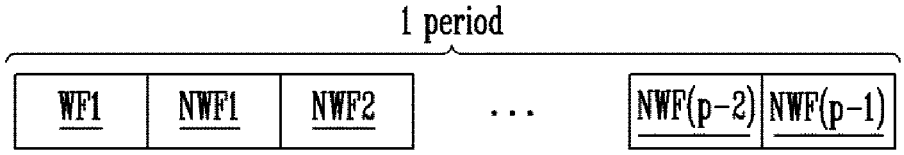
FIG. 5 is a graph illustrating a case in which a display device is driven at a low frequency.

FIG. 5 is a graph illustrating a case in which a display device is driven at a low frequency When a driving frequency of the display device is a low frequency, one period may include a first frame period of a first frame WF1 and second frame periods of second frames NWF1, NWF2, NWF(p−2), and NWF(p−1). For example, when one period is one second and the driving frequency is 1 Hz, p may be 60.

Each pixel may receive a data voltage corresponding to the first frame period of the first frame WF1. Each pixel may not receive a data voltage during the second frame periods of the second frames NWF1 to NWF(p−1). In this case, each pixel may receive a bias voltage during the second frame periods of the second frames NWF1 to NWF(p−1). Accordingly, when p is 60, each pixel may update the data voltage one time during one period.

As described above, when the driving frequency is converted from the normal frequency to the low frequency, in order to prevent unnecessary power consumption, the display device may not generate a data voltage with respect to (p−1) second frames, i.e., the second frames NWF1 to NWF. According to an exemplary of the invention, a bias voltage may be applied to data lines during the second frame periods, thereby preventing the data lines from becoming a floating state. Therefore, flickering may be prevented from occurring in a display device according to an exemplary embodiment of the invention.

Figure 6:
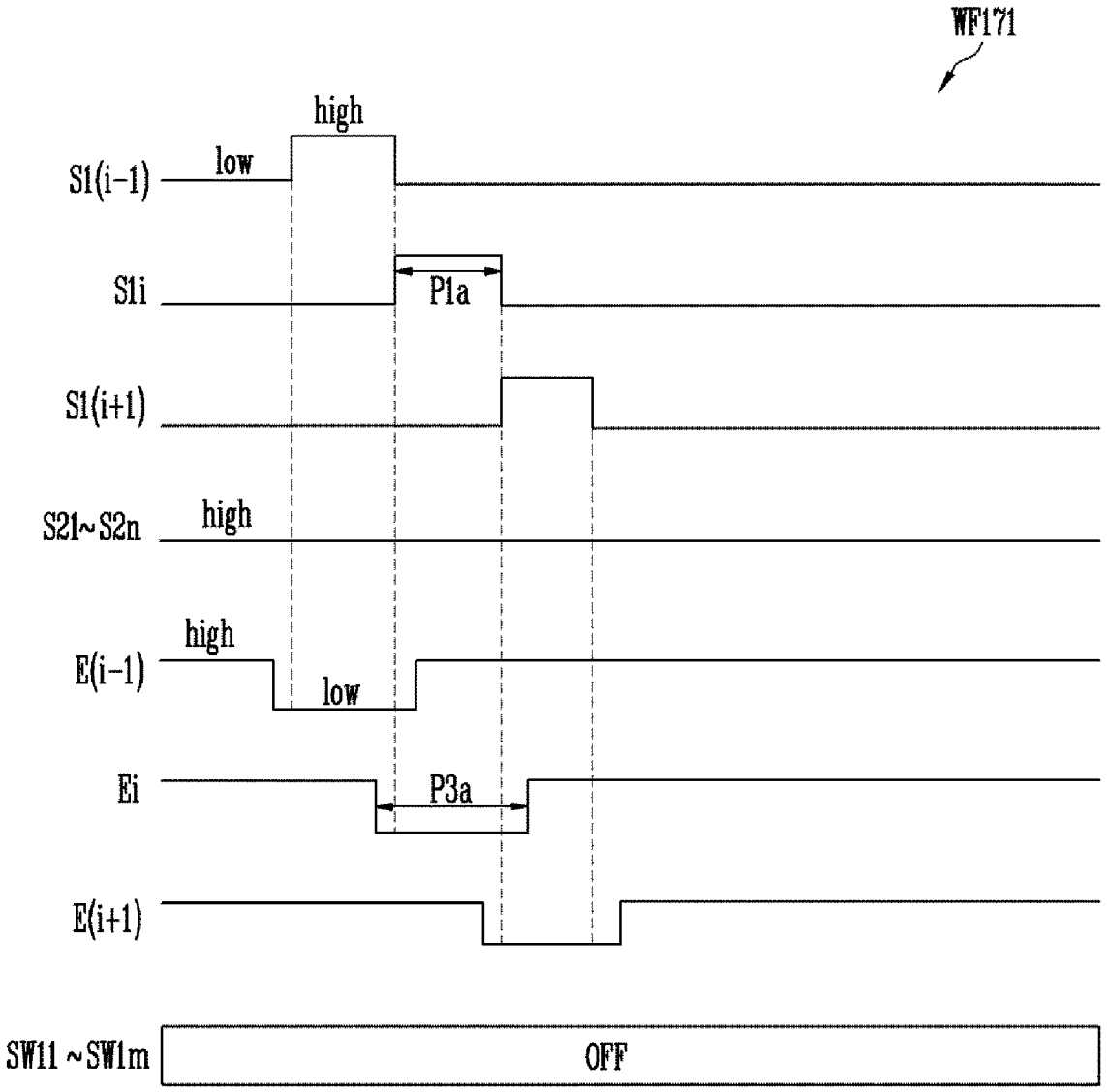
FIGS. 6 and 7 are graphs illustrating a driving method of a bias voltage applier and a pixel according to the first exemplary embodiment of the invention.
Figure 7:
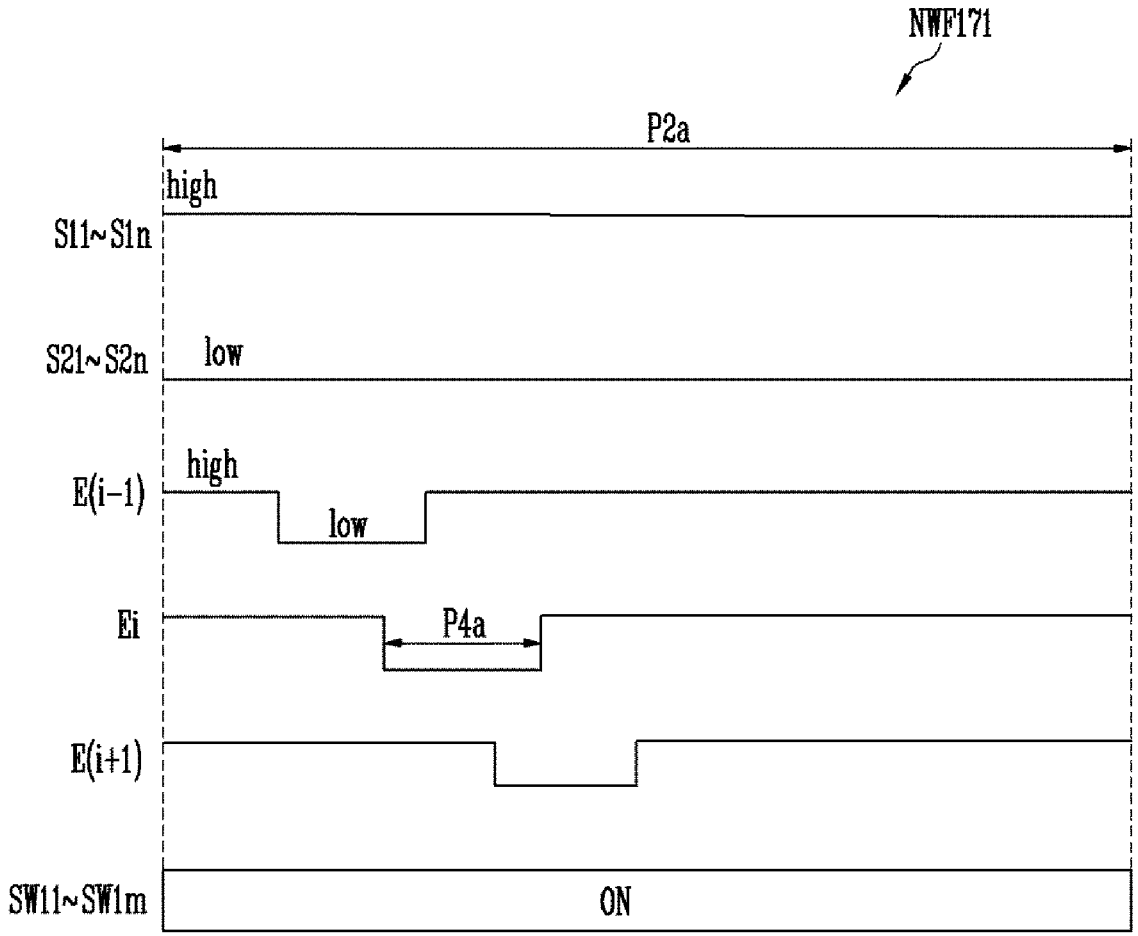

FIGS. 6 and 7 are graphs illustrating a driving method of a bias voltage applier and a pixel according to a first exemplary embodiment of the invention.

Referring to FIG. 6 (see also FIG. 3), during a first period P1*a* of a first frame WF171, a first scan signal having a turn-on level (a logic high level) may be applied to a first scan line S1*i*, a data voltage may be applied to a data line Dj, and a second scan signal having a turn-on level may be applied to a second scan line S2*i*. Here, switches SW11 to SW1*m* of a bias voltage applier 171 may maintain a turn-off state.

An emission signal having a turn-on level (=a logic low level) may be applied to an emission line Ei during a third period P3*a* of the first frame WF171. The third period P3*a* may be a period overlapping with the first period P1*a*. When an emission signal having a turn-on level is applied to the emission line Ei, a light-emitting diode LD may emit light at luminance based on a data voltage, and when an emission signal having a turn-off level is applied to the emission line E1, the light-emitting diode LD may be in a non-emission state.

Referring to FIG. 6, the first scan signals having the turn-on level may be sequentially supplied to first scan lines S1(*i*−1), S1*i*, and S1(*i*+1) during the first frame period of the first frame WF171. In addition, the second scan signals having the turn-on level may be maintained in second scan lines S21 to S2*n*. In another exemplary embodiment, the second scan signals having the turn-on level may be sequentially supplied to the second scan lines S21 to S2*n*. In this case, the second scan signals having the turn-on level may be synchronized with the first scan signals having the turn-on level.

For example, when the first scan signal having the turn-on level is applied to the first scan line S1*i*, a second transistor T2 of a pixel PXij is turned on, and a data voltage is applied to a first node N1. In addition, when the second scan signal having the turn-on level is applied to the second scan line S2*i*, a third transistor T3 of the pixel PXij is turned on, and an initialization voltage is applied to a second node N2. Accordingly, a storage capacitor Cst may store a voltage difference between the first node N1 and the second node N2. In this case, since the emission signal having the turn-off level is applied to the emission line Ei, a fourth transistor T4 is in a turn-off state, and thus, a driving current does not flow from a first power line ELVDD to a second power line ELVSS Therefore, the light-emitting diode LD is in a non-emission state.

Next, the emission signal having the turn-on level is applied to the emission line Ei. The fourth transistor T4 is in a turn-on state, and thus, the driving current may flow from the first power supply line ELVDD to the second power supply line ELVSS. An amount of the driving current is controlled according to the voltage difference stored in the storage capacitor Cst by the first transistor T1. Therefore, the light-emitting diode LD may emit light at luminance proportional to the amount of the driving current. Here, since the second transistor T2 and the third transistor T3 are in a turn-off state, the storage capacitor Cst may maintain the stored voltage difference.

Referring to FIG. 7 (see also FIGS. 3 and 6), during a second period P2*a* of a second frame NWF171, the first scan signal having the turn-on level is applied to the first scan line S1*i*, a bias voltage may be applied to a data line Dj, and the second scan signal having the turn-off level may be applied to the second scan line S2*i*. During the second period P2*a*, the data line Dj may be connected to a bias line bias1 through a switch SW1*j*.

The second frame NWF171 may be a frame subsequent to the first frame WF171, and the second period P2*a* may be longer than the first period P1*a*. The second period P2*a* may correspond to a second frame period of the second frame NWF171. For example, the second period P2*a* may be substantially the same as the second frame period of the second frame NWF171. The emission signal having the turn-off level may be applied to the emission line Ei during a fourth period P4*a* of the second frame NWF171. The second period P2*a* may be a period overlapping with the fourth period P4*a*.

The light-emitting diode LD may emit light at luminance based on a data voltage provided in the first frame WF171 during at least a portion of the first frame WF171 and at least a portion of the second frame NWF171.

Referring to FIG. 7, during the second frame period of the second frame NWF171, the first scan signals having the turn-on level may be maintained in the first scan lines S1($i$−1), S1$i$, and S1($i$+1). In addition, second scan signals having a turn-off level may be maintained in the second scan lines S21 to S2$n$.

For example, when the first scan signal having the turn-on level is maintained in the first scan line S1$i$, the second transistor T2 of the pixel PXij maintains a turn-on state. Therefore, a bias voltage may be applied to the first node N1. In addition, when the second scan signal having the turn-off level is maintained in the second scan line S2$i$, the third transistor T3 of the pixel PXij maintains a turn-off state. Thus, the second node N2 may be floated. In this case, the storage capacitor Cst may maintain the voltage difference stored in the first frame WF171. That is, a voltage level of the first node N1 is the same as a voltage level of the bias voltage, and a voltage level of the second node N2 may be lower than the voltage level of the bias voltage by the voltage difference stored in the storage capacitor Cst.

Therefore, according to an exemplary embodiment of the invention, even when a data output line DOj is floated while the driving frequency is converted from the normal frequency to the low frequency, a voltage of the first node N1 is supported by the bias voltage, thereby preventing occurrence of flickering.

Figure 8:
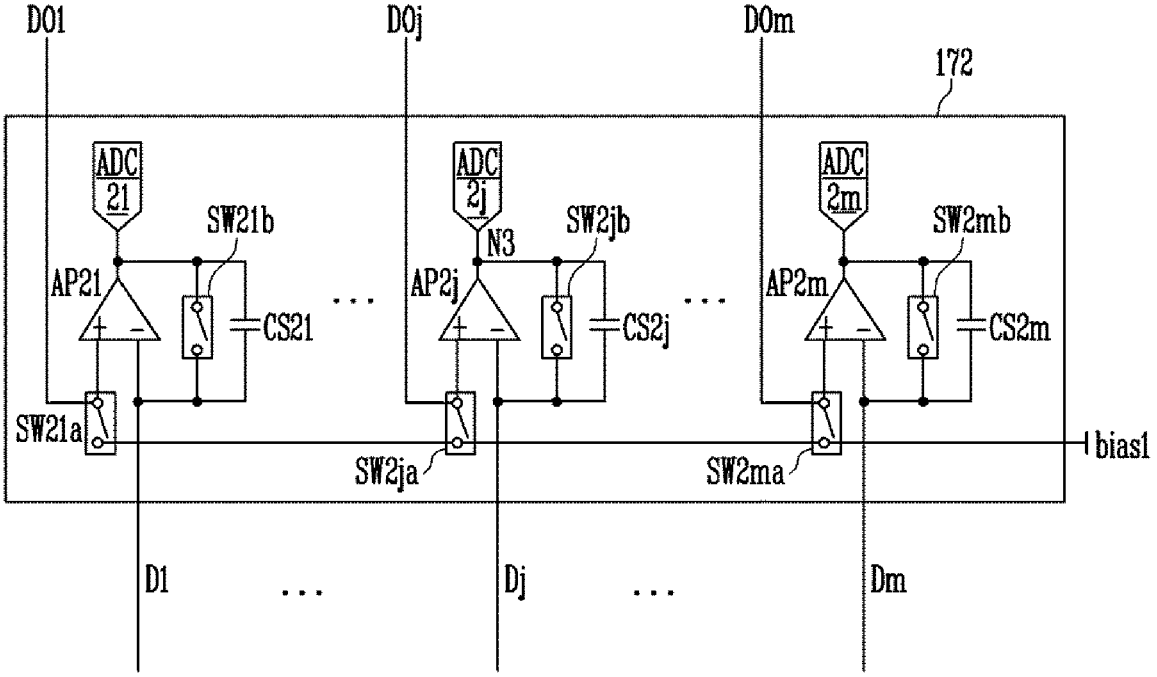
FIG. 8 is a view illustrating a bias voltage applier according to a second exemplary embodiment of the invention.

FIG. 8 is a view illustrating a bias voltage applier according to a second exemplary embodiment of the invention.

Referring to FIG. 8, a bias voltage applier 172 may include first switches SW21$a$, SW2$ja$, and SW2$ma$, second switches SW21$b$, SW2$jb$, and SW2$mb$, amplifiers AP21, AP2$j$, and AP2$m$, sampling capacitors CS21, CS2$j$, and CS2$m$, and analog-to-digital converters ADC21, ADC2$j$, and ADC2$m$.

For example, one terminal of the amplifier AP2$j$ may be connected to a data line Dj, and the other terminal thereof may be connected to a data output line DOj. In this case, one terminal of the amplifier AP2$j$ may be an inversion terminal and the other terminal may be a non-inversion terminal. For example, the amplifier AP2$j$ may be an operational amplifier. An output terminal of the amplifier AP2$j$ may be connected to a third node N3.

One terminal of the first switch SW2$ja$ may be connected to a bias line bias1, and the other terminal thereof may be connected to the amplifier AP2$j$.

One terminal of the second switch SW2$jb$ may be connected to one terminal of the amplifier AP2$j$, and the other terminal thereof may be connected to the third node N3.

One electrode of the sampling capacitor CS2$j$ may be connected to one terminal of the amplifier AP2$j$, and the other terminal thereof may be connected to the third node N3.

An input terminal of the analog-to-digital converter ADC2$j$ may be connected to the third node N3. For example, the analog-to-digital converter ADC2$j$ may convert an analog voltage applied to the third node N3 into digital information.

When the first switch SW2$ja$ is in a turn-off state, a data driver 12 may supply a data voltage to the data output line DOj. Since voltages of the inversion terminal and the non-inversion terminal of the amplifier AP2$j$ are set to be the same as each other, the data voltage is also supplied to the data line Dj.

When the first switch SW2$j$ a is in a turn-on state, the data voltage may not be supplied from the data driver 12 to the data output line DOj. Here, the data output line DOj may be in a floating state. In this case, the other terminal of the amplifier AP2$j$ may be connected to the bias line bias1 through the first switch SW2$ja$. Since the voltages of the inversion terminal and the non-inversion terminal of the amplifier AP2$j$ are set to be the same as each other, the bias voltage is also supplied to the data line Dj.

Figure 9:
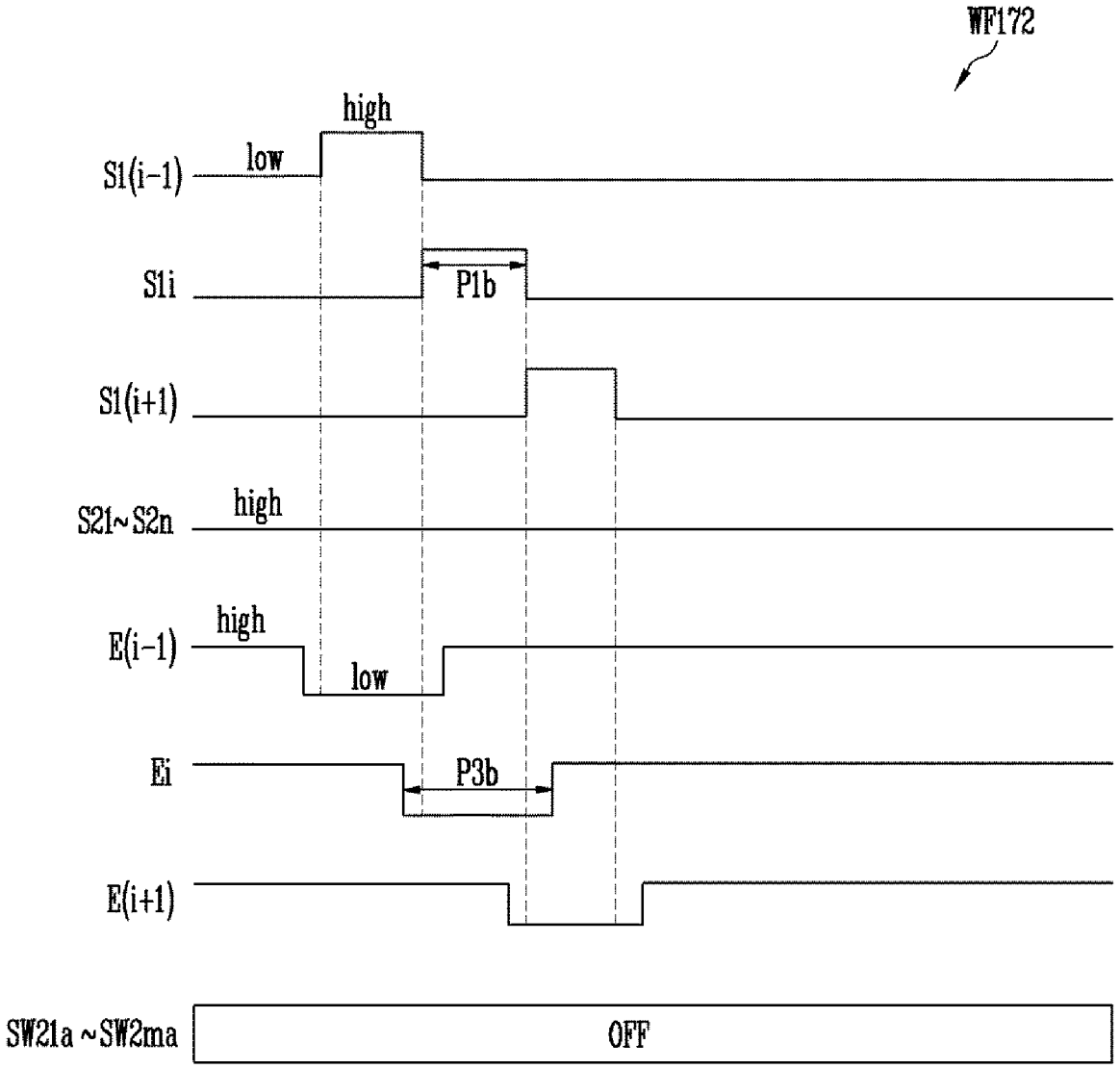
FIGS. 9 and 10 are graphs illustrating a driving method of a bias voltage applier and a pixel according to the second exemplary embodiment of the invention.
Figure 10:
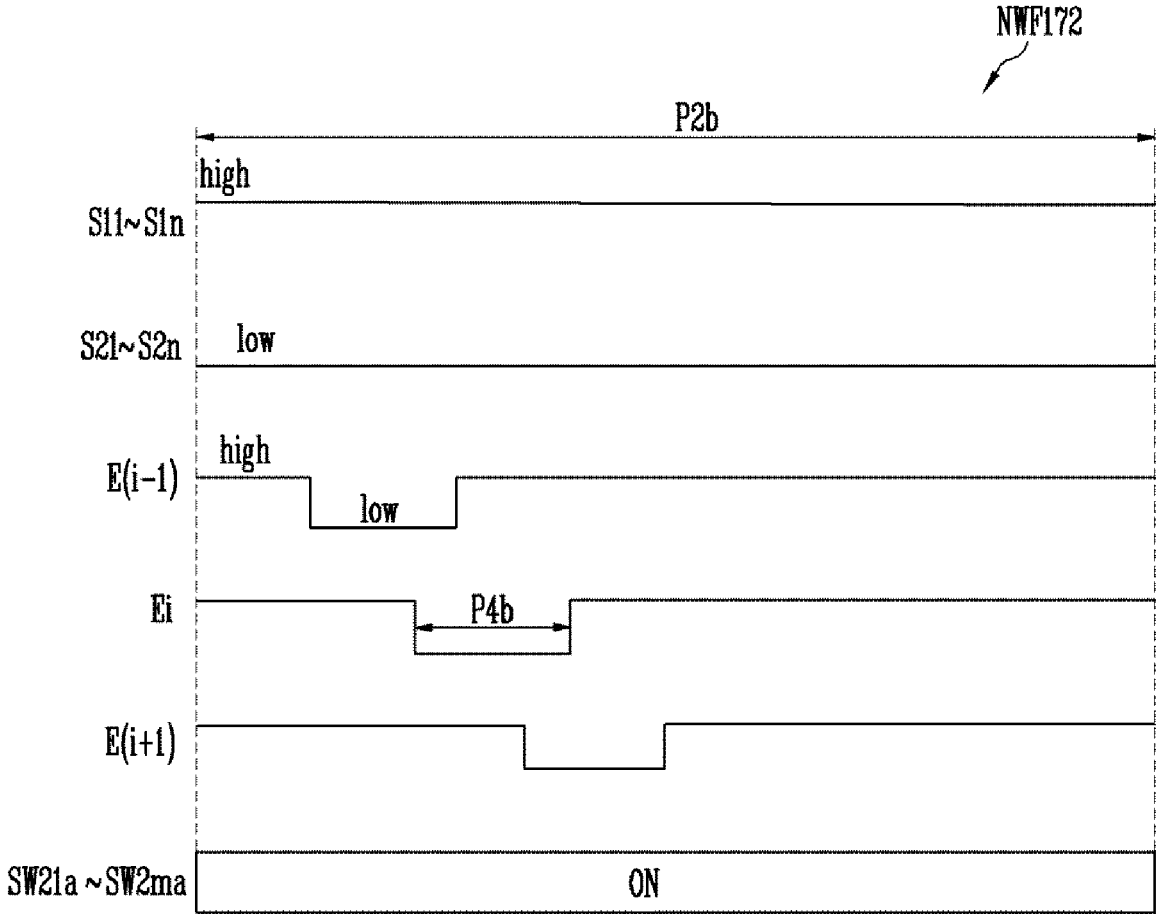

FIGS. 9 and 10 are graphs illustrating a driving method of a bias voltage applier and a pixel according to a second exemplary embodiment of the invention.

The driving method of FIGS. 9 and 10 is substantially the same as the driving method of FIGS. 6 and 7 except that a data line Dj is connected to one terminal of an amplifier AP2$j$ and the other terminal of the amplifier AP2$j$ is connected to a bias line bias1 through a first switch SW2$ja$ during a second period P2$b$. Therefore, redundant descriptions thereof will be omitted.

Figure 11:
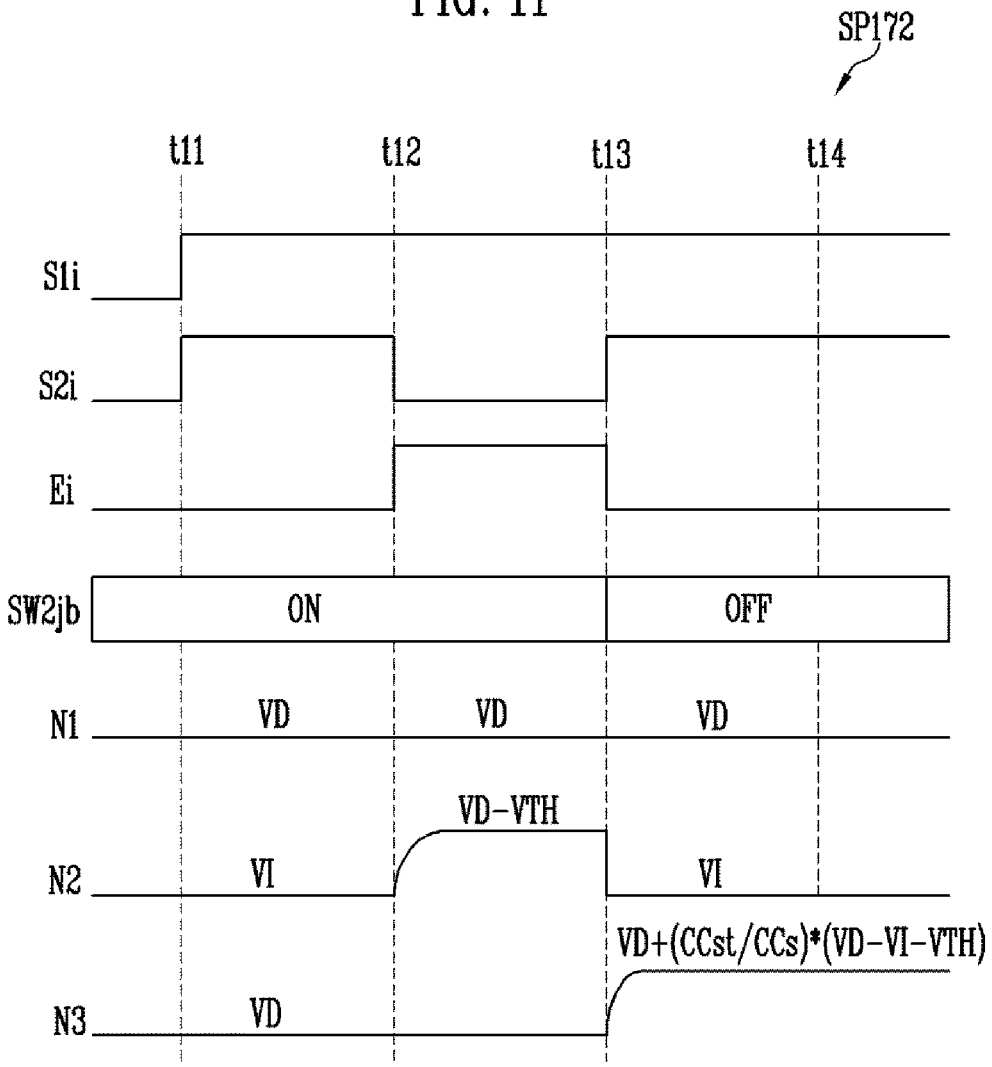
FIG. 11 is a graph illustrating a driving method of a bias voltage applier and a pixel according to the second exemplary embodiment of the invention in a sensing period.

FIG. 11 is a graph illustrating a driving method of a bias voltage applier and a pixel according to a second exemplary embodiment of the invention in a sensing period.

The bias voltage applier 172 of the second exemplary embodiment has an additional function capable of sensing a threshold voltage of the first transistor T1 when compared with the bias voltage applier 171 of the first exemplary embodiment. A sampling period SP172 may include periods t11 to t12, t12 to t13, and t13 to t14.

Referring to FIG. 11 (see also FIGS. 3 and 8), during the period t11 to t12, a first scan signal and a second scan signal have a turn-on level, and an emission signal has a turn-off level. Therefore, the second transistor T2 and the third transistor T3 are in a turn-on state, and the fourth transistor T4 is a turn-off state. Here, the second switch SW2$jb$ is in a turn-on state.

Accordingly, a data voltage VD is charged in the first node N1, and an initialization voltage VI is charged in the second node N2. Since the third node N3 is connected to the first node N1 through the second switch SW2$jb$, the data voltage VD is charged.

Next, during the period t12 to t13, a level of the second scan signal is changed into a turn-off level, and a level of the emission signal is changed into a turn-on level. Therefore, the third transistor T3 is changed into a turn-off state, and the fourth transistor T4 is changed into a turn-on state. As a result, a voltage of the second node N2 is increased to a level of VD−VTH. In this case, a electric charge amount stored in the storage capacitor Cst is represented by Equation 1 below.

$$Qa=CCst*(VTH) \quad \text{[Equation 1]}$$

Here, Qa is an electric charge amount stored in the storage capacitor Cst at a time t13, CCst is a capacitance of the storage capacitor Cst, and VTH is a threshold voltage of the first transistor T1.

In addition, since the second switch SW2$jb$ is in a turn-on state during the period t12 to t13, an electric charge amount stored in the sampling capacitor CS2$j$ is zero.

Next, during the period t13 to t14, the level of the second scan signal is changed into a turn-on level, and the level of the emission signal is changed into a turn-off level. Thus, the voltage of the second node N2 is changed into the initialization voltage VI. In this case, a electric charge amount stored in the storage capacitor Cst is represented by Equation 2 below.

$$Qb=CCst*(VD-VI) \quad \text{[Equation 2]}$$

Here, Qb is a electric charge amount stored in the storage capacitor Cst at a time t14. Therefore, a change amount of electric charges in the storage capacitor Cst is represented by Equation 3 below.

$$Qd=Qb-Qa=CCst*(VD-VI-VTH) \quad \text{[Equation 3]}$$

In addition, the second switch SW2$jb$ is turn off in the period t13-t14. Thus, the sampling capacitor CS2$j$ may store electric charges. One electrode of the sampling capacitor CS2*j* and one electrode of the storage capacitor Cst are connected through the first node N1, and a current does not flow into the inversion terminal of the amplifier AP2*j*. Therefore, a change amount of electric charges of the sampling capacitor CS2*j* is the same as a change amount of electric charges of the storage capacitor Cst (Equation 4).

$$Qs=CCs*Vs=CCst*(VD-VI-VTH) \quad \text{[Equation 4]}$$

Here, Qs is a change amount of electric charges of the sampling capacitor CS2*j*, CCs is a capacitance of the sampling capacitor CS2*j*, and Vs is a changed voltage difference between both ends of the sampling capacitor CS2*j*. Vs may be derived through Equation 5 below.

$$Vs=(CCst/CCs)*(VD-VI-VTH) \quad \text{[Equation 5]}$$

Therefore, a voltage of the third node N3 at a time t14 is represented by Equation 6 below.

$$VN3=VD+(CCst/CCs)*(VD-VI-VTH) \quad \text{[Equation 6]}$$

In this case, VN3 is a voltage of the third node N3.

In Equation 6, VN3 may be measured by the analog-to-digital converter ADC2*j*, and VD, CCst, CCs, and VI are known values so that the threshold voltage VTH of the first transistor may be known.

Figure 12:
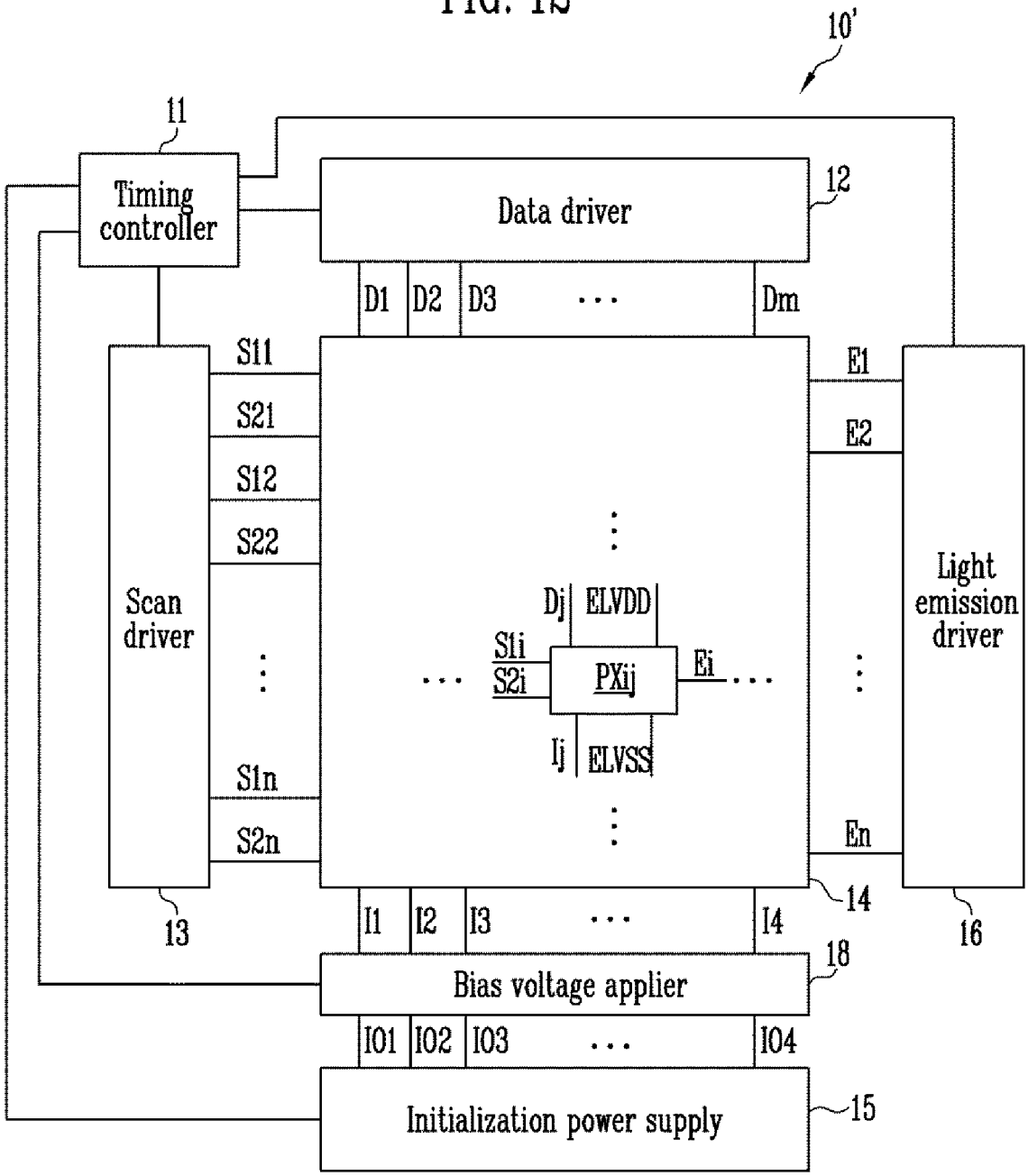
FIG. 12 is a view illustrating a display device according to another exemplary embodiment of the invention.

FIG. 12 is a view illustrating a display device according to another exemplary embodiment of the invention.

Referring to FIG. 12, a display device 10' includes a timing controller 11, a data driver 12, a scan driver 13, a pixel unit 14, an initialization power supply 15, a light emission driver 16, and a bias voltage applier 18.

The bias voltage applier 18 may transfer initialization voltages provided from initialization output lines 101, 102, 103, and IOm to initialization lines I1, I2, I3, Ij, and Im or may bias voltages to the initialization lines I1, I2, I3, Ij, and Im by connecting the initialization lines I1, I2, I3, Ij, Im to bias lines.

Since other components of the display device 10' are substantially the same as those of the display device 10, redundant descriptions thereof will be omitted.

Figure 13:
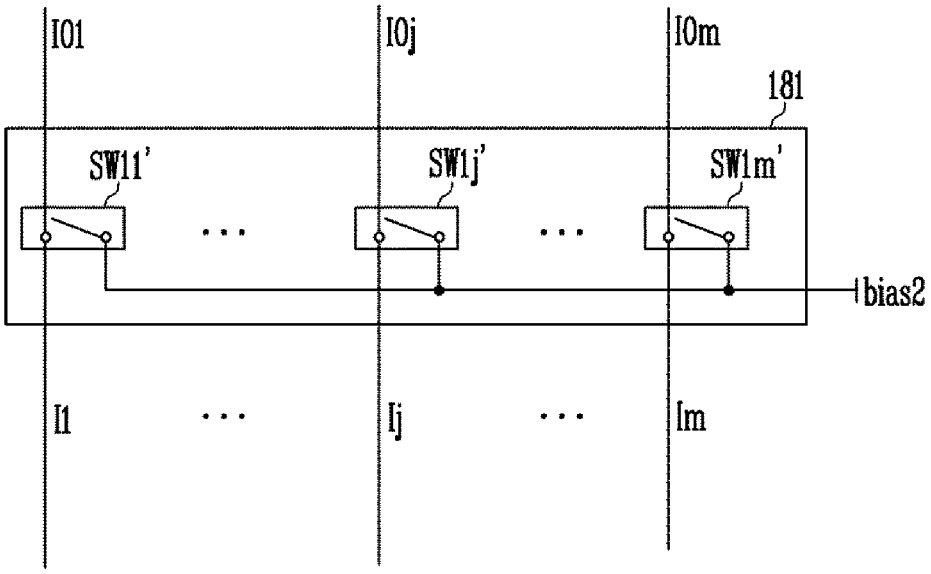
FIG. 13 is a view illustrating a bias voltage applier according to a third exemplary embodiment of the invention.

FIG. 13 is a view illustrating a bias voltage applier according to a third exemplary embodiment of the invention.

Referring to FIG. 13, a bias voltage applier 181 according to the third exemplary embodiment of the invention may include switches SW11', SW1*j*', and SW1*m*'.

The number of the switches SW11', SW1*j*', and SW1*m*' may correspond to the number of initialization lines I1, Ij, and Im. For example, the number of the switches SW11', SW1*j*', and SW1*m*' may be the same as the number of the initialization lines I1, Ij, and Im.

For example, one terminal of the switch SW1*j* ' may be connected to the initialization line Ij, and the other terminal thereof may be connected to a bias line bias2. For example, regardless of a state of the switch SW1*j*', the initialization output line IOj and the initialization line Ij may be always connected.

When the switch SW1*j*' is in a turn-off state, the initialization line Ij may receive an initialization voltage from the initialization output line IOj.

When the switch SW1*j*' is in a turn-on state, the initialization line Ij may be connected to the bias line bias2. In this case, a bias voltage applied to the bias line bias2 may be applied to the initialization line Ij. In this case, the initialization output line IOj may be in a floating state. That is, the initialization voltage may not be supplied from an initialization power supply 15 to the initialization output line IOj.

Figure 14:
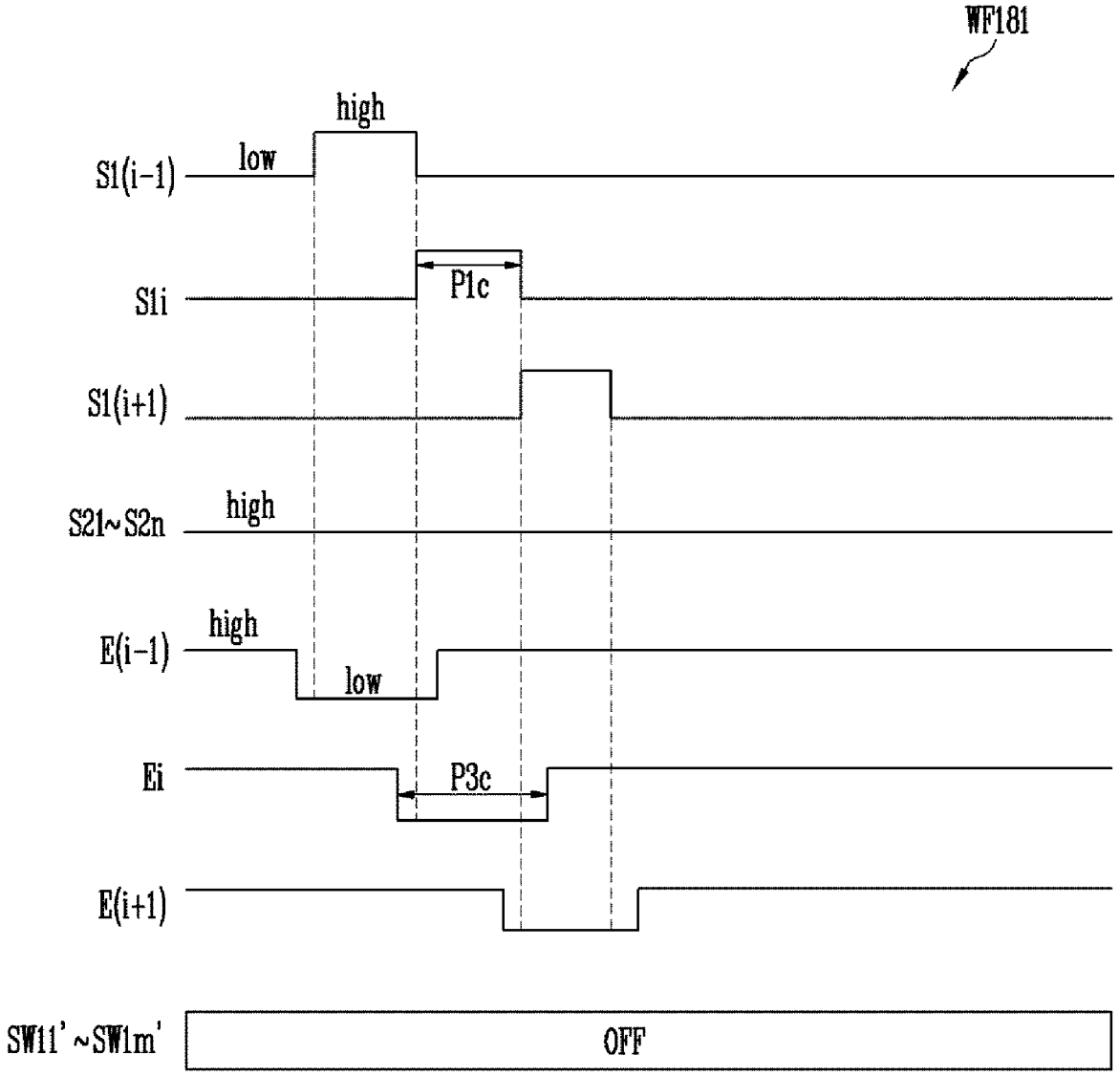
FIGS. 14 and 15 are graphs illustrating a driving method of a bias voltage applier and a pixel according to the third second exemplary embodiment of the invention.
Figure 15:
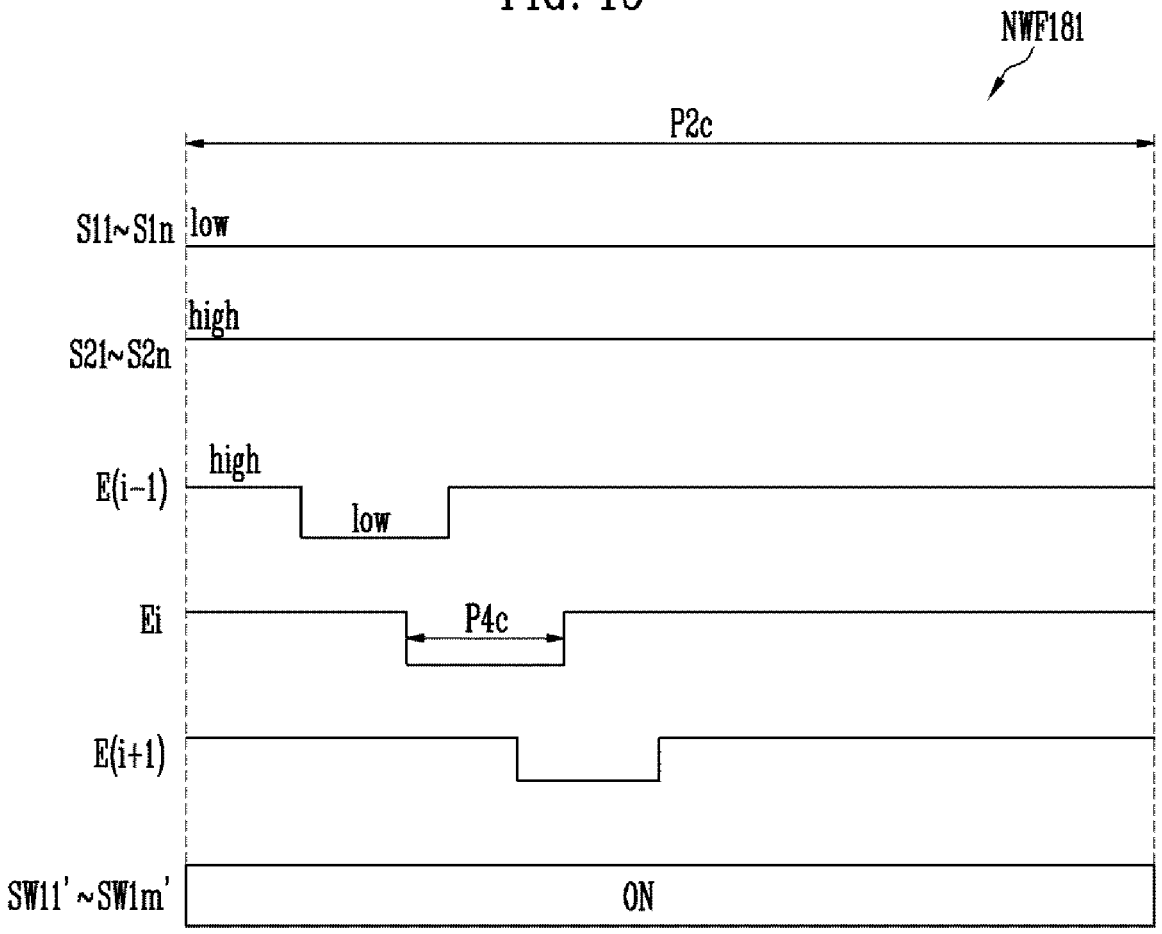

FIGS. 14 and 15 are graphs illustrating a driving method of a bias voltage applier and a pixel according to the third second exemplary embodiment of the invention.

Referring to FIG. 14 (see also FIG. 3), during a first period P1*c* of a first frame WF181, a first scan signal having a turn-on level may be applied to a first scan line S1*i*, a data voltage may be applied to a data line Dj, and a second scan signal having a turn-on level may be applied to a second scan line S2*i*. Here, the switches SW11' to SW1*m*' of the bias voltage applier 181 may maintain a turn-off state.

An emission signal having a turn-off level may be applied to an emission line Ei during a third period P3*c* of the first frame WF181. The third period P3*c* may be a period overlapping with the first period P1*c*. When an emission signal having a turn-on level is applied to the emission line Ei, a light-emitting diode LD may emit light at luminance based on a data voltage, and when an emission signal having a turn-off level is applied to the emission line E1, the light-emitting diode LD may be in a non-emission state.

Referring to FIG. 15, first scan signals having a turn-on level may be sequentially supplied to first scan lines S1(*i*−1), S1*i*, and S1(*i*+1) during the first frame period of the first frame WF181. In addition, second scan signals having a turn-on level may be maintained in second scan lines S21 to S2*n*. In another exemplary embodiment, the second scan signals having the turn-on level may be sequentially supplied to the second scan lines S21 to S2*n*. In this case, the second scan signals having the turn-on level may be synchronized with the first scan signals having the turn-on level.

For example, when the first scan signal having the turn-on level is applied to the first scan line S1*i*, a second transistor T2 of a pixel PXij is turned on, and a data voltage is applied to a first node N1. In addition, when the second scan signal having the turn-on level is applied to the second scan line S2*i*, a third transistor T3 of the pixel PXij is turned on, and an initialization voltage is applied to a second node N2. Accordingly, a storage capacitor Cst may store a voltage difference between the first node N1 and the second node N2. In this case, since the emission signal having the turn-off level is applied to the emission line Ei, a fourth transistor T4 is in a turn-off state, and thus, a driving current does not flow from a first power line ELVDD to a second power line ELVSS. Therefore, the light-emitting diode LD is in a non-emission state.

Next, the emission signal having the turn-on level is applied to the emission line Ei. The fourth transistor T4 is in a turn-on state, and thus, the driving current may flow from the first power supply line ELVDD to the second power supply line ELVSS. An amount of the driving current is controlled according to the voltage difference stored in the storage capacitor Cst by the first transistor T1. Therefore, the light-emitting diode LD may emit light at luminance proportional to the amount of the driving current. Here, since the second transistor T2 and the third transistor T3 are in a turn-off state, the storage capacitor Cst may maintain the stored voltage difference.

Referring to FIG. 15 (see also FIGS. 3 and 14), during a second period P2*c* of a second frame NWF181, a first scan signal having a turn-off level is applied to the first scan line S1*i*, a bias voltage may be applied to the initialization line Ij, and a second scan signal having a turn-on level may be applied to the second scan line S2*i*. During a second period P2*c*, the initialization line Ij may be connected to the bias line bias2 through the switch SW1*j*'.

The second frame NWF181 may be a frame subsequent to the first frame WF181, and the second period P2*c* may be longer than the first period P1*c*. The second period P2*c* may correspond to a second frame period of the second frame NWF181. For example, the second period P2*c* may be substantially the same as the second frame period of the second frame NWF181. The emission signal having the turn-off level may be applied to the emission line Ei during a fourth period P4*c* of the second frame NWF181. The second period P2*c* may be a period overlapping with the fourth period P4*c*.

The light-emitting diode LD may emit light at luminance based on a data voltage provided in the first frame WF181 during at least a portion of the first frame WF181 and at least a portion of the second frame NWF181.

Referring to FIG. 15, during the second frame period of the second frame NWF181, the first scan signals having the turn-off level may be maintained in the first scan lines S1(*i*−1), S1*i*, and S1(*i*+1). In addition, the second scan signals having the turn-on level may be maintained in the second scan lines S21 to S2*n*.

For example, when the second scan signal having the turn-on level is maintained in the second scan line S2*i*, the third transistor T3 of the pixel PXij maintains a turn-off state. Thus, a bias voltage may be applied to the second node N2. Furthermore, when the first scan signal having the turn-off level is maintained in the first scan line S1*i*, the second transistor T2 of the pixel PXij maintains a turn-off state. Therefore, the first node N1 may be floated. In this case, the storage capacitor Cst may maintain the voltage difference stored in the first frame WF181. That is, a voltage level of the second node N2 is the same as a voltage level of the bias voltage, and a voltage level of the first node N1 may be higher than the voltage level of the bias voltage by the voltage difference stored in the storage capacitor Cst.

Therefore, according to an exemplary embodiment of the invention, even when the initialization output line IOj is floated while a driving frequency is converted from a normal frequency to a low frequency, a voltage of the second node N2 is supported by the bias voltage, thereby preventing occurrence of flickering.

Figure 16:
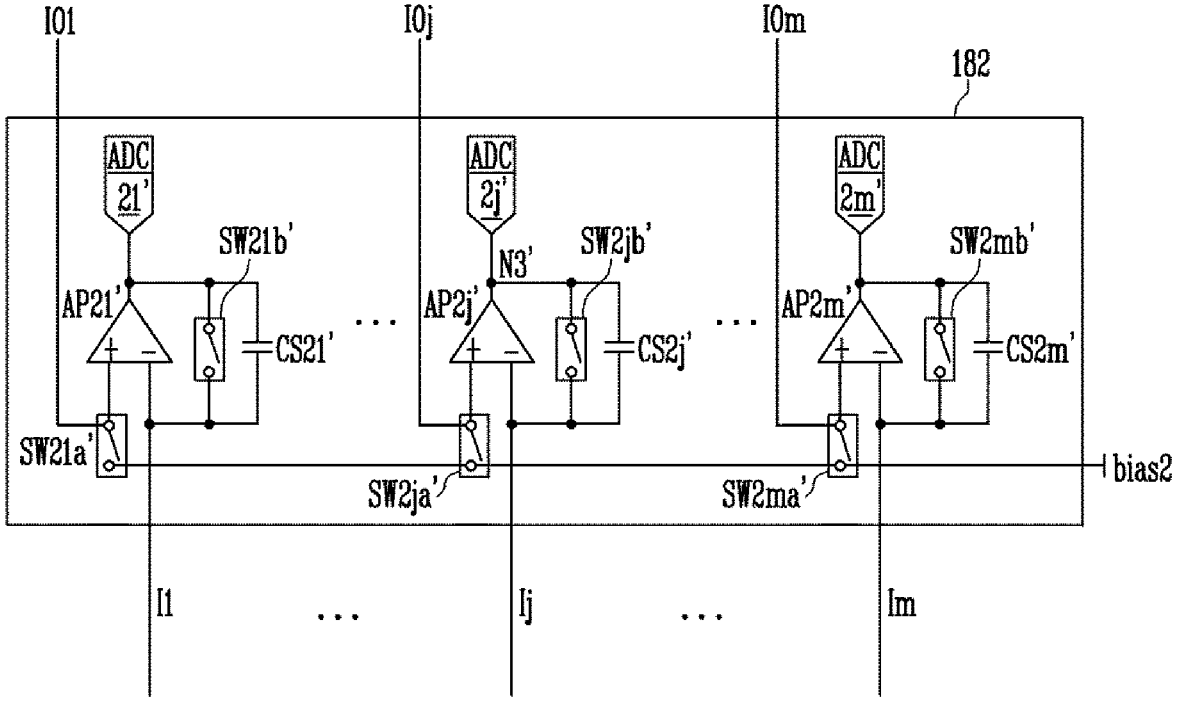
FIG. 16 is a view illustrating a bias voltage applier according to a fourth exemplary embodiment of the invention.

FIG. 16 is a view illustrating a bias voltage applier according to a fourth exemplary embodiment of the invention.

Referring to FIG. 16, a bias voltage applier 182 may include first switches SW21*a*', SW2*ja*', and SW2*ma*', second switches SW21*b*', SW2*jb*', and SW2*mb*', amplifiers AP21' AP2*j*', and AP2*m*', sampling capacitors CS21', CS2*j*', and CS2*m*', and analog-to-digital converters ADC21', ADC2*j*', and ADC2*m*'.

For example, one terminal of the amplifier AP2*j*' may be connected to an initialization line Ij, and the other terminal thereof may be connected to an initialization output line IOj. In this case, one terminal of the amplifier AP2*j*' may be an inversion terminal and the other terminal may be a non-inversion terminal. For example, the amplifier AP2*j*' may be an operational amplifier. An output terminal of the amplifier AP2*j*' may be connected to a third node N3'.

One terminal of the first switch SW2*ja*' may be connected to a bias line bias2, and the other terminal thereof may be connected to the amplifier AP2*j*'.

One terminal of the second switch SW2*jb*' may be connected to one terminal of the amplifier AP2*j*', and the other terminal thereof may be connected to the third node N3'.

One electrode of the sampling capacitor CS2*j*' may be connected to one terminal of the amplifier AP2*j*', and the other terminal thereof may be connected to the third node N3'.

An input terminal of the analog-to-digital converter ADC2*j*' may be connected to the third node N3'. For example, the analog-to-digital converter ADC2*j*' may convert an analog voltage applied to the third node N3' into digital information.

When the first switch SW2*ja*' is in a turn-off state, an initialization power supply 15 may not supply an initialization voltage to the initialization output line IOj. Since voltages of an inversion terminal and a non-inversion terminal of the amplifier AP2*j*' are set to be the same as each other, the data voltage is also supplied to the initialization line Ij.

When the first switch SW2*ja*' is in a turn-on state, the initialization power supply 15 may not supply the initialization voltage to the initialization output line IOj. In this case, the initialization output line IOj may be in a floating state. In this case, the other terminal of the amplifier AP2*j*' may be connected to the bias line bias2 through the second switch SW2*j* a'. Since the voltages of the inversion terminal and the non-inversion terminal of the amplifier AP2*j*' are set to be the same as each other, a bias voltage is also supplied to the initialization line Ij.

Figure 17:
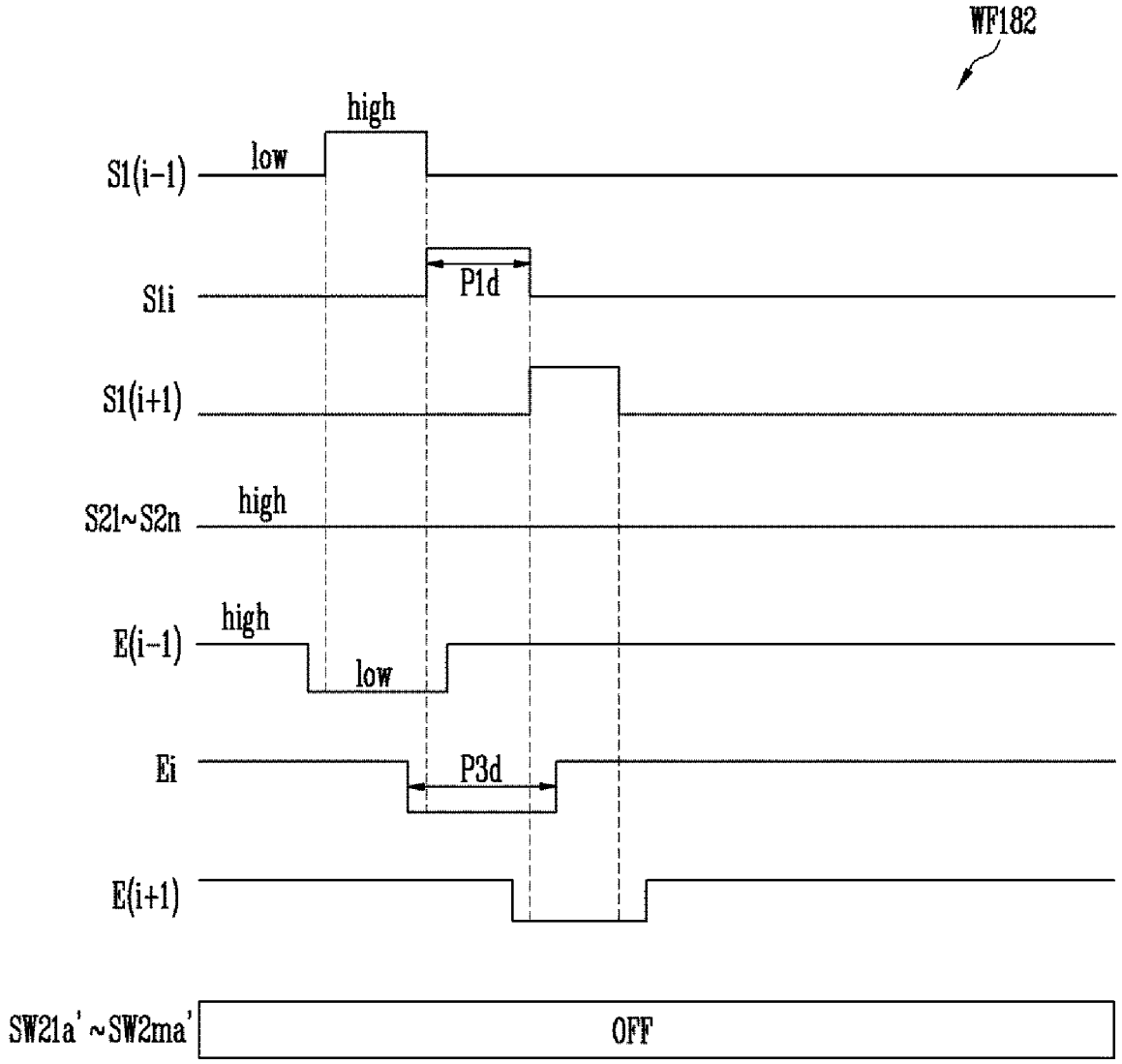
FIGS. 17 and 18 are graphs illustrating a driving method of a bias voltage applier and a pixel according to the fourth exemplary embodiment of the invention.
Figure 18:
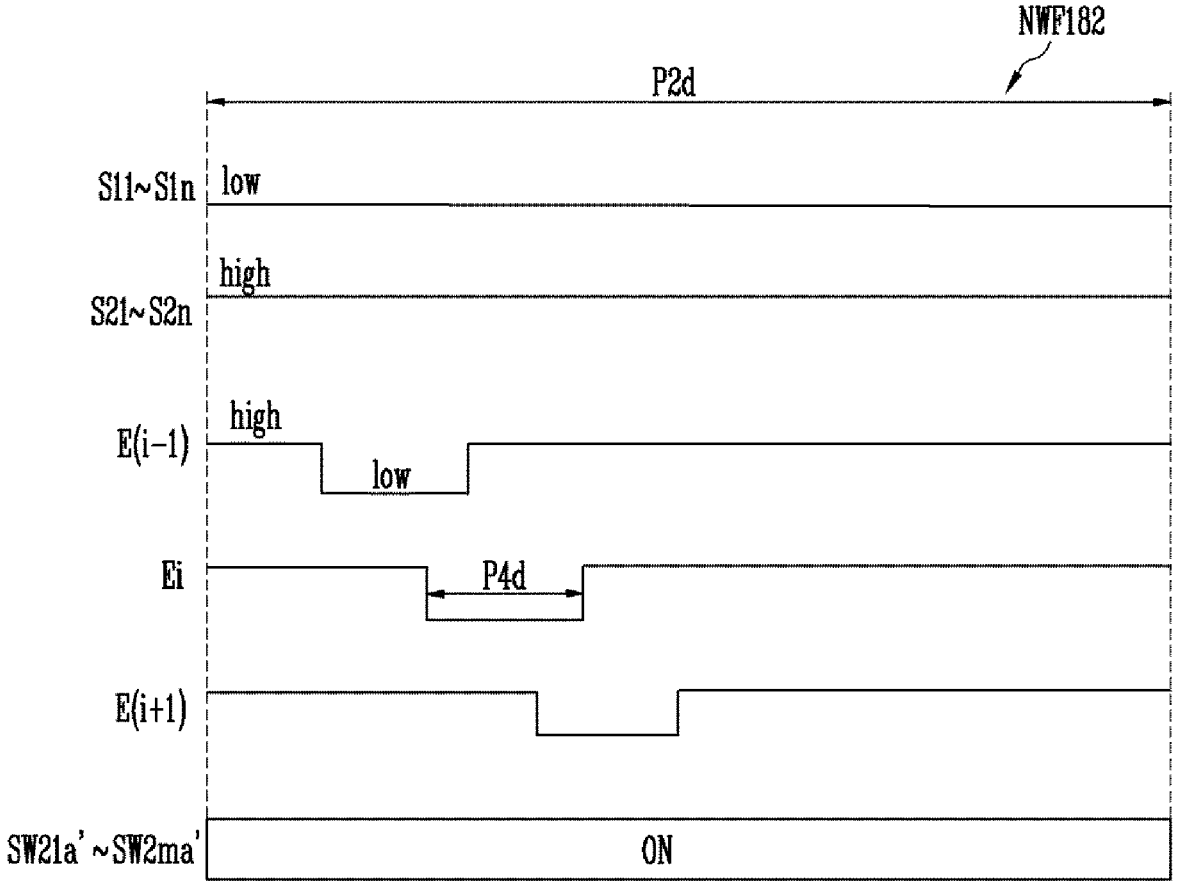

FIGS. 17 and 18 are graphs illustrating a driving method of a bias voltage applier and a pixel according to the fourth exemplary embodiment of the invention.

The driving method of FIGS. 17 and 18 is substantially the same as the driving method of FIGS. 14 and 15 except that the initialization line Ij is connected to one terminal of the amplifier AP2*j*' and the other terminal of the amplifier AP2*j*' is connected to the bias line bias2 through the first switch SW2*ja*' during a second period Ptd. Therefore, redundant descriptions thereof will be omitted.

Figure 19:
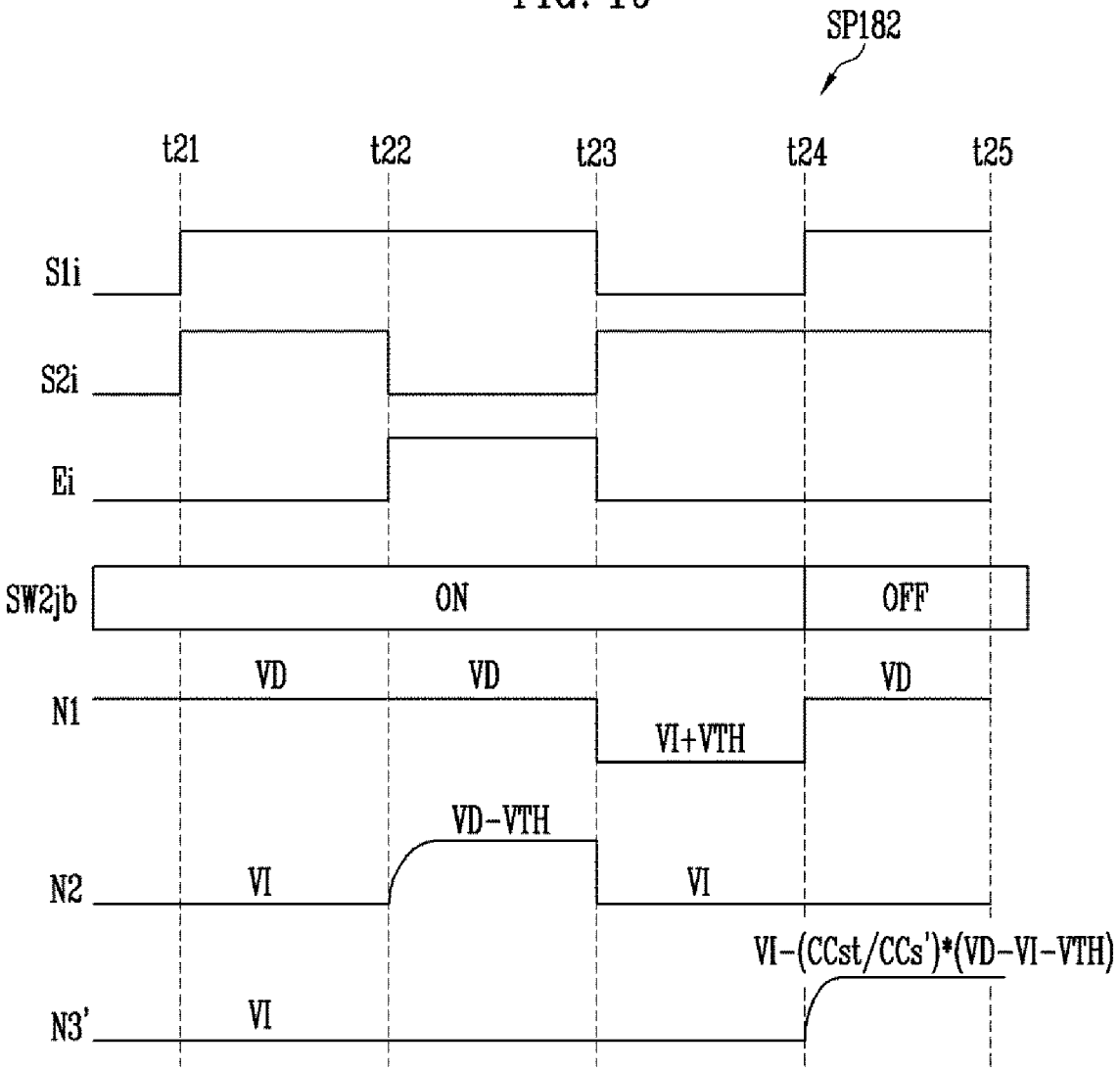
FIG. 19 is a graph illustrating a driving method of a bias voltage applier and a pixel according to the fourth exemplary embodiment of the invention in a sensing period.

FIG. 19 is a graph illustrating a driving method of a bias voltage applier and a pixel according to the fourth exemplary embodiment of the invention in a sensing period.

The bias voltage applier 182 of the fourth exemplary embodiment has an additional function capable of sensing a threshold voltage VTH of the first transistor T1 when compared with the bias voltage applier 181 of the third exemplary embodiment. A sampling period SP182 may include periods t21-t22, t22-t23, t23-t24, and t24-t25.

Referring to FIG. 19 (see also FIGS. 3 and 16), during the period t21 to t22, a first scan signal and a second scan signal have a turn-on level, and an emission signal has a turn-off level. Therefore, a second transistor T2 and a third transistor T3 are in a turn-on state, and a fourth transistor T4 is a turn-off state. Here, the second switch SW2*jb*' is in a turn-on state.

Accordingly, a data voltage VD is charged in a first node N1, and an initialization voltage VI is charged in a second node N2. Since the third node N3' is connected to the second node N2 through the second switch SW2*jb*', the initialization voltage VI is charged.

Next, during the period t22 to t23, a level of the second scan signal is changed into a turn-off level, and a level of the emission signal is changed into a turn-on level. Therefore, the third transistor T3 is changed into a turn-off state, and the fourth transistor T4 is changed into a turn-on state. As a result, a voltage of the second node N2 is increased to a level of VD−VTH. In this case, a charge quantity stored in a storage capacitor Cst is represented by Equation 1 below.

$$Qa'=CCst*(VTH) \quad \text{[Equation 7]}$$

Here, Qa' is an electric charge amount stored in the storage capacitor Cst at a time t23, CCst is a capacitance of the storage capacitor Cst, and VTH is a threshold voltage of the first transistor T1.

In addition, since the second switch SW2*jb*' is in a turn-on state during the period t22 to t23, an electric charge amount stored in the sampling capacitor CS2*j*' is zero.

Next, during the period t23 to t24, a level of the first scan signal is changed into a turn-off level, a level of the second scan signal is changed into a turn-on level, and a level of the emission signal is changed into a turn-off level. Thus, the voltage of the second node N2 is changed into the initialization voltage VI. In this case, since the first node N1 is in a floating state, a voltage of the first node N1 is changed into VI+VTH.

Next, during the period t24 to t25, a level of the first scan signal is changed into a turn-on level. Therefore, the data voltage VD may be applied to the first node N1. In this case, an electric charge amount stored in the storage capacitor Cst is represented by Equation 8 below.

$$Qb'=CCst*(VD-VI) \quad \text{[Equation 8]}$$

Here, Qb is an electric charge amount stored in the storage capacitor Cst at a time t25. Therefore, a change amount of electric charges in the storage capacitor Cst is represented by Equation 9 below.

$$Qd'=Qb'-Qa'=CCst*(VD-VI-VTH) \quad \text{[Equation 9]}$$

In addition, the second switch SW2*jb*' is turned off in the period T24 to t15. Thus, the sampling capacitor CS2*j*' may store electric charges. In this case, one electrode of the sampling capacitor CS2*j*' and one electrode of the storage capacitor Cst are connected through the second node N2, and a current does not flow into the inversion terminal of the amplifier AP2*j*'. Therefore, a change amount of electric charges of the sampling capacitor CS2*j*' is the same as a change amount of electric charges of the storage capacitor Cst (Equation 10).

$$Qs'=CCs'*Vs'=CCst*(VD-VI-VTH) \quad \text{[Equation 10]}$$

Here, Qs' is a change amount of electric charges of the sampling capacitor CS2*j*', CCs' is a capacitance of the sampling capacitor CS2*j*', and Vs' is a voltage difference between both ends of the sampling capacitor CS2*j*'. Vs' may be derived through Equation 11 below.

$$Vs'=(CCst/CCs')*(VD-VI-VTH) \quad \text{[Equation 11]}$$

Therefore, at a time t25, a voltage of the third node N3' is represented by Equation 12 below.

$$VN3'=VI-(CCst/CCs')*(VD-VI-VTH) \quad \text{[Equation 12]}$$

In this case, VN3' is a voltage of the third node N3.

In Equation 12, VN3' may be measured by the analog-to-digital converter ADC2*j*', and VD, CCst, CCs', and VI are known values so that the threshold voltage VTH of the first transistor may be known.

Display devices and methods of driving the same according to the principles and exemplary embodiments of the invention may prevent flicker from occurring when a driving frequency is converted from a normal frequency to a low frequency.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A method of driving a display device including a pixel, wherein the pixel comprises a first node connected to a data line when a first scan signal having a turn-on level is applied to a first scan line, a second node connected to an initialization line when a second scan signal having a turn-on level is applied to a second scan line, a first transistor of which a gate electrode is connected to the first node and one electrode is connected to the second node, and a light-emitting diode of which an anode is connected to the second node, wherein the method comprises the steps of:

during a first period of a first frame, applying the first scan signal having the turn-on level to the first scan line, applying a data voltage to the data line, and applying the second scan signal having the turn-on level to the second scan line; and during a second period of a second frame, applying the first scan signal having the turn-on level to the first scan line, applying a bias voltage to the data line, and applying the second scan signal having a turn-off level to the second scan line, wherein the second frame is a frame subsequent to the first frame, wherein the second period is longer than the first period, and wherein the light-emitting diode emits light at luminance based on the data voltage during at least a portion of the first frame and at least a portion of the second frame.

2. The method of claim 1, wherein the light-emitting diode emits the light at the luminance based on the data voltage when an emission signal having a turn-on level is applied to an emission line and is in a non-emission state when the emission signal having a turn-off level is applied to the emission line, the emission signal having the turn-off level is applied to the emission line during a third period of the first frame and a fourth period of the second frame, the third period is a period overlapping with the first period, and the second period is a period overlapping with the fourth period.

3. The method of claim 2, wherein the data line is connected to a bias line through a first switch during the second period.

4. The method of claim 2, wherein the data line is connected to one terminal of an amplifier, and another terminal of the amplifier is connected to a bias line through a first switch during the second period.

5. A method of driving a display device including a pixel, wherein the pixel includes a first node connected to a data line when a first scan signal having a turn-on level is applied to a first scan line, a second node connected to an initialization line when a second scan signal having a turn-on level is applied to a second scan line, a first transistor of which a gate electrode is connected to the first node and one electrode is connected to the second node, and a light-emitting diode of which an anode is connected to the second node, wherein the method comprises the steps of:

during a first period of a first frame, applying the first scan signal having the turn-on level to the first scan line, applying a data voltage to the data line, and applying the second scan signal having the turn-on level to the second scan line; and during a second period of a second frame, applying the first scan signal having a turn-off level to the first scan line, applying a bias voltage to the initialization line, and applying the second scan signal having the turn-on level to the second scan line, wherein the second frame is a frame subsequent to the first frame, wherein the second period is longer than the first period, and wherein the light-emitting diode emits light at luminance based on the data voltage during at least a portion of the first frame and at least a portion of the second frame.

6. The method of claim 5, wherein the light-emitting diode emits the light at the luminance based on the data voltage when an emission signal having a turn-on level is applied to an emission line and is in a non-emission state when the emission signal having a turn-off level is applied to the emission line, the emission signal having the turn-off level is applied to the emission line during a third period of the first frame and a fourth period of the second frame, the third period is a period including the first period, and the second period is a period including the fourth period.

7. The method of claim 6, wherein the initialization line is connected to a bias line through a first switch during the second period.

8. The method of claim 6, wherein the initialization line is connected to one terminal of an amplifier, and another terminal of the amplifier is connected to a bias line through a first switch during the second period.

9. A display device comprising:

a pixel; and a bias voltage applier connected to the pixel, wherein the pixel includes:

a first transistor including a gate electrode connected to a first node and one electrode connected to a second node;

a second transistor including a gate electrode connected to a first scan line, one electrode connected to a data line, and another electrode connected to the first node;

a third transistor including a gate electrode connected to a second scan line, one electrode connected to the second node, and another electrode connected to an initialization line;

a storage capacitor including one electrode connected to the first node and another electrode connected to the second node; and a light-emitting diode including an anode connected to the second node, and wherein the bias voltage applier includes:

a first switch including one terminal connected to a bias line; and an amplifier including one terminal connected to the pixel and another terminal connected to another terminal of the first switch.

10. The display device of claim 9, wherein the bias voltage applier further comprises:

a second switch including one terminal connected to the one terminal of the amplifier and another terminal connected to an output terminal of the amplifier; and a sampling capacitor including one electrode connected to the one terminal of the amplifier and another terminal connected to the output terminal of the amplifier.

11. The display device of claim 10, wherein the one terminal of the amplifier is connected to the data line.

12. The display device of claim 11, wherein, during a first period of a first frame, the second transistor and the third transistor are in a turn-on state, and the first switch is in a turn-off state.

13. The display device of claim 12, wherein, during a second period of a second frame, the second transistor is in a turn-on state, the third transistor is in a turn-off state, and the first switch is in a turn-on state.

14. The display device of claim 13, wherein the second frame is a frame subsequent to the first frame, and the second period is longer than the first period.

15. The display device of claim 14, wherein the pixel further includes a fourth transistor including a gate electrode connected to an emission line and one electrode connected to the other electrode of the first transistor, the fourth transistor is in a turn-off state during a third period of the first frame and a fourth period of the second frame, the third period is a period overlapping with the first period, and the second period is a period overlapping with the fourth period.

16. The display device of claim 10, wherein the one terminal of the amplifier is connected to the initialization line.

17. The display device of claim 16, wherein, during a first period of a first frame, the second transistor and the third transistor are in a turn-on state, and the first switch is in a turn-off state.

18. The display device of claim 17, wherein, during a second period of a second frame, the second transistor is in a turn-off state, the third transistor is in a turn-on state, and the first switch is in a turn-on state.

19. The display device of claim 18, wherein the second frame is a frame subsequent to the first frame, and the second period is longer than the first period.

20. The display device of claim 19, wherein the pixel further comprises a fourth transistor including a gate electrode connected to an emission line and one electrode connected to the other electrode of the first transistor, the fourth transistor is in a turn-off state during a third period of the first frame and a fourth period of the second frame, the third period is a period overlapping with the first period, and the second period is a period overlapping with the fourth period.

* * * * *